US009199816B2

(12) United States Patent
Blanding et al.

(10) Patent No.: US 9,199,816 B2
(45) Date of Patent: Dec. 1, 2015

(54) METHODS AND APPARATUS FOR GUIDING FLEXIBLE GLASS RIBBONS

(75) Inventors: Douglass L Blanding, Painted Post, NY (US); Sean Matthew Garner, Elmira, NY (US); Gary Edward Merz, Rochester, NY (US); John Earl Tosch, Wellsburg, NY (US)

(73) Assignee: Corning Incorporated, Corning, NY (US)

( * ) Notice: Subject to any disclaimer, the term of this patent is extended or adjusted under 35 U.S.C. 154(b) by 1023 days.

(21) Appl. No.: 13/272,511

(22) Filed: Oct. 13, 2011

(65) Prior Publication Data

US 2012/0111054 A1 May 10, 2012

Related U.S. Application Data

(60) Provisional application No. 61/410,075, filed on Nov. 4, 2010.

(51) Int. Cl.
*C03B 13/00* (2006.01)
*B65H 23/032* (2006.01)

(52) U.S. Cl.
CPC .... *B65H 23/0322* (2013.01); *B65H 2301/3422* (2013.01); *B65H 2301/4423* (2013.01); *B65H 2404/1521* (2013.01); *B65H 2404/1526* (2013.01); *B65H 2406/111* (2013.01); *B65H 2701/17* (2013.01)

(58) Field of Classification Search
CPC ..... B65H 23/0322; B65H 2701/17; B65H 2301/3422; B65H 2301/4423; B65H 2404/1526; B65H 2404/1521; B65H 2406/111
USPC ..... 65/245, 253–257, 370.1, 193–201, 185, 65/99.5
See application file for complete search history.

(56) References Cited

U.S. PATENT DOCUMENTS 769,850 A 9/1904 Thompson
1,399,547 A * 12/1921 Ewing ..... 65/162
(Continued)

FOREIGN PATENT DOCUMENTS

CN 1649800 8/2005
CN 202359018 8/2012
(Continued)

OTHER PUBLICATIONS

The State Intellectual Property Office of The People's Republic of China; Search Report; pp. 1-2.

*Primary Examiner* — Richard Crispino
*Assistant Examiner* — Yana B Krinker
(74) *Attorney, Agent, or Firm* — Jeffrey A. Schmidt; Maurice M. Klee

(57) ABSTRACT

Methods and apparatus for guiding flexible glass ribbons (13) without mechanically contacting the central portion (4) of the ribbon are provided in which two curved sections are formed in the ribbon which stiffen the ribbon so that lateral forces can be applied to the ribbon without causing it to buckle. The curvatures of the curved sections are along the direction of motion (15) of the ribbon and can be produced using curved air-bars (12,14) and/or pairs of cylindrical rollers (5*a*,5*b*,16*a*, 16*b*). The lateral forces can be applied by pairs of guide rollers (7*a*,7*b*,9*a*,9*b*) which can be mounted on spring-loaded pivot arms (6,19,29) and can have a complaint outer coating or sleeve (35). The guiding system can be used in the winding of the glass ribbon onto a cylindrical core (11).

9 Claims, 7 Drawing Sheets

(56) References Cited

U.S. PATENT DOCUMENTS

| | | | | | |
|---|---|---|---|---|---|
| 2,262,638 | A | | 11/1941 | Ferm | 271/2.6 |
| 3,089,801 | A | | 5/1963 | Tierney et al. | 154/47 |
| 3,391,053 | A | | 7/1968 | Kolb | 161/185 |
| 3,485,615 | A | * | 12/1969 | Carson et al. | 65/181 |
| 3,565,596 | A | | 2/1971 | McCown et al. | 65/182 |
| 3,573,026 | A | | 3/1971 | Maltby, Jr. et al. | 65/182 |
| 3,574,030 | A | | 4/1971 | Callander et al. | 156/244 |
| 3,593,841 | A | | 7/1971 | Leow | 198/202 |
| 3,701,644 | A | * | 10/1972 | Frank | 65/106 |
| 3,771,987 | A | * | 11/1973 | Davis et al. | 65/172 |
| 3,831,239 | A | * | 8/1974 | Hoff et al. | 65/370.1 |
| 3,877,919 | A | * | 4/1975 | Shorr | 65/194 |
| 3,913,729 | A | | 10/1975 | Andrews | 198/202 |
| 3,962,799 | A | * | 6/1976 | Lapointe et al. | 34/570 |
| 4,182,472 | A | * | 1/1980 | Peekna | 242/615.12 |
| 4,212,419 | A | | 7/1980 | Huber | 226/23 |
| 4,226,608 | A | * | 10/1980 | McKelvey | 65/106 |
| 4,367,031 | A | | 1/1983 | Hamaker | 355/3 BE |
| 4,385,716 | A | | 5/1983 | DeRoeck et al. | 226/18 |
| 4,556,406 | A | * | 12/1985 | Kahle | 65/106 |
| 4,608,073 | A | * | 8/1986 | Ford et al. | 65/163 |
| 4,612,030 | A | * | 9/1986 | Smids | 65/91 |
| 4,626,267 | A | * | 12/1986 | Reese et al. | 65/106 |
| 5,383,006 | A | | 1/1995 | Castelli | 388/212 |
| 5,558,263 | A | * | 9/1996 | Long | 226/114 |
| 5,562,750 | A | * | 10/1996 | Letemps et al. | 65/107 |
| 5,876,474 | A | | 3/1999 | Maltby, Jr. et al. | 65/60.1 |
| 6,004,432 | A | * | 12/1999 | Page et al. | 162/281 |
| 6,116,410 | A | | 9/2000 | Malmberg | 198/806 |
| 6,125,754 | A | | 10/2000 | Harris | 101/420 |
| 6,220,056 | B1 | | 4/2001 | Ostendarp | 65/175 |
| 6,279,347 | B1 | * | 8/2001 | Yoshizawa | 65/102 |
| 6,363,751 | B1 | * | 4/2002 | Hirotsu et al. | 65/182.2 |
| 6,363,753 | B1 | * | 4/2002 | Yoshizawa et al. | 65/287 |
| 6,502,423 | B1 | * | 1/2003 | Ostendarp et al. | 65/29.14 |
| 6,502,425 | B1 | * | 1/2003 | Yoshizawa | 65/106 |
| 6,698,243 | B1 | * | 3/2004 | Yoshizawa | 65/104 |
| 6,769,684 | B2 | | 8/2004 | Gandelheidt | 271/276 |
| 6,896,646 | B2 | * | 5/2005 | Kaiser et al. | 492/40 |
| 7,007,511 | B2 | | 3/2006 | Lautenschlager et al. | 65/25.3 |
| 7,107,792 | B2 | | 9/2006 | Langsdorf et al. | 65/25.2 |
| 7,337,633 | B2 | | 3/2008 | Shiraishi et al. | 65/25.2 |
| 8,025,832 | B2 | * | 9/2011 | Akilian et al. | 264/322 |
| 8,701,442 | B2 | * | 4/2014 | Teranishi et al. | 65/196 |
| 2003/0116910 | A1 | * | 6/2003 | Lautenschlager et al. | 271/275 |
| 2004/0089693 | A1 | * | 5/2004 | Weis | 226/10 |
| 2006/0042314 | A1 | * | 3/2006 | Abbott et al. | 65/25.3 |
| 2009/0019892 | A1 | * | 1/2009 | Fredholm et al. | 65/91 |
| 2010/0107848 | A1 | * | 5/2010 | Joseph et al. | 83/862 |
| 2010/0126226 | A1 | * | 5/2010 | Zhou et al. | 65/158 |
| 2010/0242546 | A1 | * | 9/2010 | Tsuji et al. | 65/370.1 |
| 2012/0111054 | A1 | | 5/2012 | Blanding et al. | 65/25.4 |
| 2012/0247154 | A1 | * | 10/2012 | Abramov et al. | 65/54 |
| 2012/0255672 | A1 | * | 10/2012 | Marshall et al. | 156/216 |

FOREIGN PATENT DOCUMENTS

| | | | | | |
|---|---|---|---|---|---|
| EP | 0716339 | B1 | | 9/2001 | G03C 1/74 |
| TW | I327552 | | | 12/1995 | |
| WO | WO 2006121709 | A1 | * | 11/2006 | |
| WO | 2009/057460 | A1 | | 5/2009 | C03B 40/33 |
| WO | 2010/038757 | A1 | | 4/2010 | B65D 85/86 |
| WO | 2010/038758 | A1 | | 4/2010 | B65D 85/86 |
| WO | 2010/038759 | A1 | | 4/2010 | B65D 85/86 |
| WO | 2010/038760 | A1 | | 4/2010 | B65D 85/86 |
| WO | 2010/038761 | A1 | | 4/2010 | B65D 85/86 |
| WO | WO 2010132419 | A1 | * | 11/2010 | |

* cited by examiner

METHODS AND APPARATUS FOR GUIDING FLEXIBLE GLASS RIBBONS

This application claims the benefit of priority under 35 U.S.C. §119 of U.S. Provisional Application Ser. No. 61/410,075 filed on Nov. 4, 2010, the content of which is relied upon and incorporated herein by reference in its entirety.

FIELD

This disclosure relates to the guiding of flexible glass ribbons without damaging the central portion (quality portion) of the ribbon. Among other things, such guiding can be used in the winding of a thin glass ribbon on a cylindrical core.

DEFINITIONS

As used herein, a guide roller is "mechanically adjacent" to a curved section of a glass ribbon if the guide roller is close enough to the curved section so that the glass ribbon continues to exhibit a level of across-the-ribbon stiffness due to having been curved that is sufficient to allow the roller to move the ribbon laterally without buckling.

As used herein, the term "glass" includes glass and glass-ceramic materials.

BACKGROUND

Although formed continuously, glass is typically segmented into sheets as soon as it has cooled and solidified. Recent product trends have resulted in requirements for thinner glass. As glass thickness decreases, the sheets and the ribbons from which they are cut become more flexible. This flexibility creates a challenge from a handling perspective, particularly for glass thinner than 0.3 mm.

Glass has a number of unique features that make guiding a glass ribbon particularly challenging. First, the glass is extremely sensitive to surface defects. These defects create stress points that generate cracks and lead to breakage. Thus, direct contact with the glass surface, as is typically done to edge-guide a plastic, paper, or metal web, must be done in a way that minimizes the forces on the glass. Second, when subject to lateral forces, a thin glass ribbon can buckle and eventually break. In contrast, polymer films and paper webs are more compliant and thus respond better to lateral forces.

Third, the ribbon-forming process can produce variations in the thickness of the ribbon across its width, as well as "camber" in the motion of the ribbon. FIG. 1 illustrates a glass ribbon 13 which exhibits camber 10 (greatly exaggerated in this figure for purposes of illustration). As can be seen, camber is a continuous curvature of the ribbon in one direction (i.e., to the right in FIG. 1). Such curvature can be caused by, for example, different rates of cooling of a ribbon's edge beads. Camber, thickness variation, and residual stresses in the glass ribbon can cause the ribbon to shift laterally, rather than conveying in a straight line.

These unique features of glass ribbons make conveying and winding of ribbons of thin glass more challenging than conveying and winding of flexible webs in the plastic, paper, and metal foil industries. In these other industries, guiding of a web is typically accomplished by using fixed edge guides that rub against the web's edges. Experiments have shown that these techniques are a complete failure when applied to thin glass ribbons because they cause the ribbon to break.

A solution to the guiding problem for thin glass ribbons would allow the ribbon to be wound in a continuous format and provided to users in that form. The users, in turn, could process the glass in the continuous format to make such products as ePaper front plane substrates, photovoltaics protective cover sheets, touch sensors, solid state lighting, solid state electronics, and the like. In general terms, continuous processing is advantageous both to the glass manufacturer and to the user. A need thus exists for effective methods of guiding thin glass ribbons. The present disclosure addresses this need.

SUMMARY

In accordance with a first aspect, apparatus is disclosed for guiding a moving glass ribbon (13) having a central portion (4) and first and second edges (3*a*,3*b*) which includes:

(a) a first ribbon-guiding assembly (1) which includes:
  (i) a first ribbon-curving subassembly (5*a*,5*b*,14,22) for producing a first curved section of the ribbon (13) without mechanically contacting the central portion (4) of the ribbon, the curvature of the section being along the direction of motion (15) of the ribbon; and
  (ii) first and second guide rollers (7*a*,7*b*) for engaging and applying lateral force to, respectively, the first and second edges (3*a*,3*b*) of the ribbon, the engagement being in or mechanically adjacent the first curved section of the ribbon; and (b) a second ribbon-guiding assembly (2) which includes:
  (i) a second ribbon-curving subassembly (12,16*a*,16*b*) for producing a second curved section of the ribbon (13) without mechanically contacting the central portion (4) of the ribbon, the curvature of the section being along the direction of motion (15) of the ribbon; and
  (ii) third and fourth guide rollers (9*a*,9*b*) for engaging and applying lateral force to, respectively, the first and second edges (3*a*,3*b*) of the ribbon, the engagement being in or mechanically adjacent the second curved section of the ribbon;

wherein the curvatures of each of the first and second sections stiffens the ribbon (13) to an extent sufficient to permit the guide rollers (7*a*,7*b*,9*a*,9*b*) to laterally move the ribbon without causing it to buckle.

In accordance with a second aspect, a method is disclosed for guiding a moving glass ribbon (13) having a central portion (4) and first and second edges (3*a*,3*b*) which includes:

(a) creating a first curved section of the ribbon (13) without mechanically contacting the central portion (4) of the ribbon, the curvature of the section being along the direction of motion (15) of the ribbon;
(b) applying lateral forces to the first and second edges (3*a*,3*b*) of the ribbon in or mechanically adjacent to the first curved section of the ribbon (13);
(c) creating a second curved section of the ribbon (13) without mechanically contacting the central portion (4) of the ribbon, the curvature of the section being along the direction of motion (15) of the ribbon; and
(d) applying lateral forces to the first and second edges (3*a*,3*b*) of the ribbon in or mechanically adjacent to the second curved section of the ribbon (13);

wherein the curvatures of each of the first and second sections stiffens the ribbon (13) to an extent sufficient to permit the lateral forces to guide the ribbon without causing it to buckle.

In accordance with a third aspect, a curved air-bar assembly is disclosed which includes a first curved air-bar subsection (41), a second curved air-bar subsection (43), a frame (49), a first coupling mechanism (45,51) connecting the first curved air-bar subsection (41) to the frame (49), and a second coupling mechanism (47,51) connecting the second curved air-bar subsection (43) to the frame (49), the first and second coupling mechanisms being individually adjustable to allow the lateral positions of the first (41) and second (43) curved air-bar subsections relative to the frame (49) to be independently adjusted.

The reference numbers used in the above summaries of the various aspects of the disclosure are only for the convenience of the reader and are not intended to and should not be interpreted as limiting the scope of the invention. More generally, it is to be understood that both the foregoing general description and the following detailed description are merely exemplary of the invention and are intended to provide an overview or framework for understanding the nature and character of the invention.

Additional features and advantages of the invention are set forth in the detailed description which follows, and in part will be readily apparent to those skilled in the art from that description or recognized by practicing the invention as exemplified by the description herein. The accompanying drawings are included to provide a further understanding of the invention, and are incorporated in and constitute a part of this specification. It is to be understood that the various features of the invention disclosed in this specification and in the drawings can be used in any and all combinations. For example, the various features of the invention may be combined according to the following additional aspects of the invention.

According to a fourth aspect, there is provided the apparatus of aspect 1 wherein:

(a) the first ribbon-curving subassembly comprises at least one of:
  (i) a curved air-bar, and
  (ii) a pair of cylindrical rollers which contact the surface of the ribbon outside of, and on opposite sides of, the ribbon's central portion; and
(b) the second ribbon-curving subassembly comprises at least one of:
  (i) a curved air-bar, and
  (ii) a pair of cylindrical rollers which contact the surface of the ribbon outside of, and on opposite sides of, the ribbon's central portion.

According to a fifth aspect, there is provided the apparatus of aspect 1 or aspect 4 wherein each of the guide rollers is carried by a pivot arm and each of the pivot arms is spring-loaded to bias its guide roller against the edge of the ribbon.

According to a sixth aspect, there is provided the apparatus of any one of aspects 1 or 4-5 wherein each of the guide rollers has a glass-engaging surface which comprises silicone rubber.

According to a seventh aspect, there is provided the apparatus of any one of aspects 1 or 4-6 wherein the apparatus comprises a ribbon-biasing assembly between the first and second ribbon-guiding assemblies for biasing the ribbon towards the first and second ribbon-curving subassemblies without mechanically contacting the central portion of the ribbon.

According to an eighth aspect, there is provided the apparatus of aspect 7 wherein the ribbon-biasing assembly comprises at least one of:

(a) a curved air-bar, and
(b) a pair of cylindrical rollers which contact the surface of the ribbon outside of, and on opposite sides of, the ribbon's central portion.

According to a ninth aspect, there is provided the apparatus of any one of aspects 1 or 4-8 wherein at least one of the first and second ribbon-curving subassemblies comprises a curved air-bar having first and second curved air-bar subsections whose across-the-ribbon positions are independently adjustable.

According to a tenth aspect, there is provided the apparatus of any one of aspects 1 or 4-9 wherein the ribbon's central portion is at least 90% of the ribbon's width.

According to an eleventh aspect, there is provided an apparatus for winding a moving glass ribbon onto a cylindrical core comprising the apparatus of any one of aspects 1 or 4-10.

According to a twelfth aspect, there is provided the method of aspect 2 wherein the curvatures of the first and second sections of the ribbon are concave towards the same side of the ribbon.

According to a thirteenth aspect, there is provided the method of aspect 2 or aspect 12 wherein the ribbon is guided while its motion includes primarily a vertical component and the method further comprises creating a third curved section of the ribbon between the first and second curved sections without mechanically contacting the central portion of the ribbon, the curvature of the third section being: (i) along the direction of motion of the ribbon and (ii) concave in a direction opposite to that of the first and second curved sections.

According to a fourteenth aspect, there is provided the method of any one of aspects 2 or 12-13 wherein the ribbon is guided while its motion includes primarily a horizontal component and the curvatures are concave downward.

According to a fifteenth aspect, there is provided the method of any one of aspects 2 or 12-14 comprising creating a free loop of the ribbon prior to the first and second curved sections, the free loop being concave upward.

According to a sixteenth aspect, there is provided the method of any one of aspects 2 or 13 or 15 wherein the curvatures of the first and second sections of the ribbon are concave towards opposite sides of the ribbon.

According to a seventeenth aspect, there is provided the method of any one of aspects 2 or 12-16 wherein the first and second curved sections are each produced by at least one of:

(a) a curved air-bar, and
(b) a pair of cylindrical rollers which contact the surface of the ribbon outside of, and on opposite sides of, the ribbon's central portion.

According to an eighteenth aspect, there is provided the method of any one of aspects 2 or 12-17 further comprising using a pair of curved air-bars to produce at least one of the first and second curved sections of the ribbon and adjusting an across-the-ribbon position of at least one of the pair of curved air-bars at least once.

According to a nineteenth aspect, there is provided the method of any one of aspects 2 or 12-18 wherein the ribbon has a thickness which is less than or equal to 0.3 millimeters.

According to a twentieth aspect, there is provided the method of any one of aspects 2 or 12-19 wherein the ribbon exhibits at least one of camber and an across-the-ribbon thickness variation.

DETAILED DESCRIPTION

For ease of presentation, the following discussion is primarily in terms of guiding a thin, flexible glass ribbon 13 for winding onto a cylindrical core 11, it being understood that the guiding apparatus disclosed herein can be used in a variety of other applications, e.g., as part of a process which produces individual glass sheets.

The glass ribbon can be produced by various glass forming processes known in the art, including the overflow downdraw fusion process, the slot draw process, other downdraw processes, the float process, and the like. The ribbon can have various compositions and thicknesses, but in general, the guiding apparatus disclosed herein will be of particular value with thin ribbons having a thickness less than or equal to 0.3 millimeters, e.g., thicknesses on the order of 0.22 millimeters and below. Depending on the processes used, the ribbon can have beaded or non-beaded edges, e.g., the beads can be removed from the ribbon prior to guiding and winding.

Figure 1:
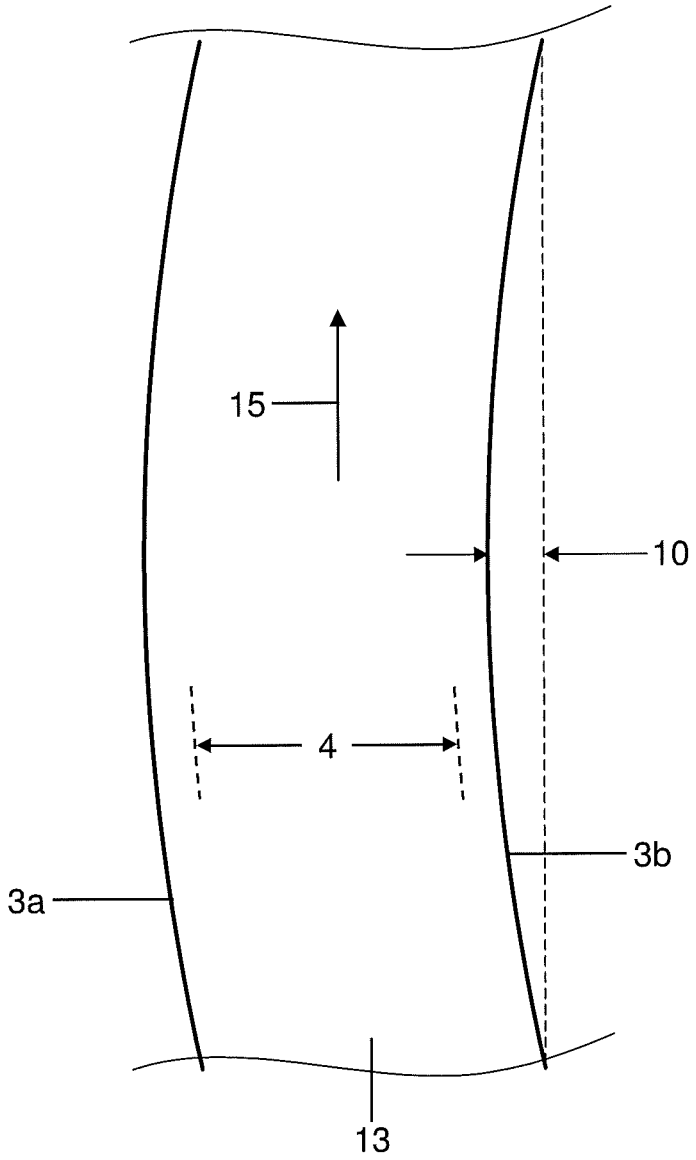
FIG. 1 is a top view schematic diagram illustrating the motion of a ribbon which exhibits camber.
Figure 2:
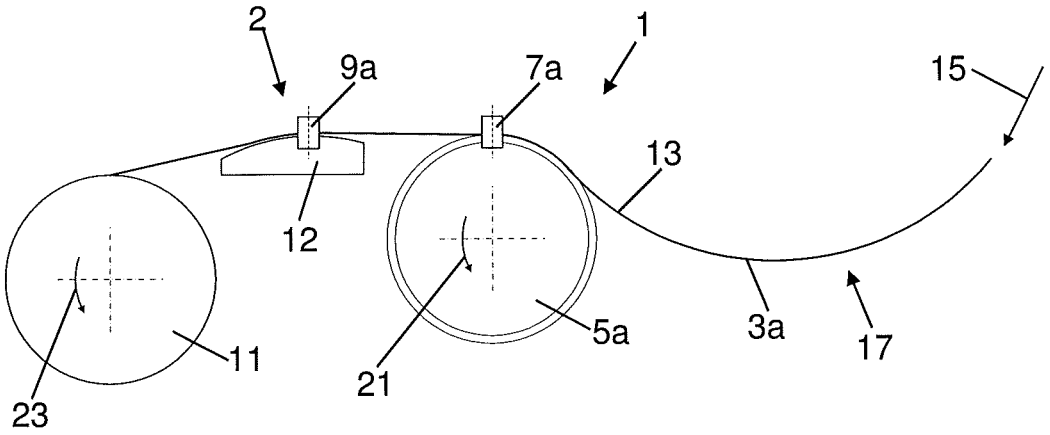
FIG. 2 is a side view schematic diagram of an embodiment of the present disclosure.
Figure 3:
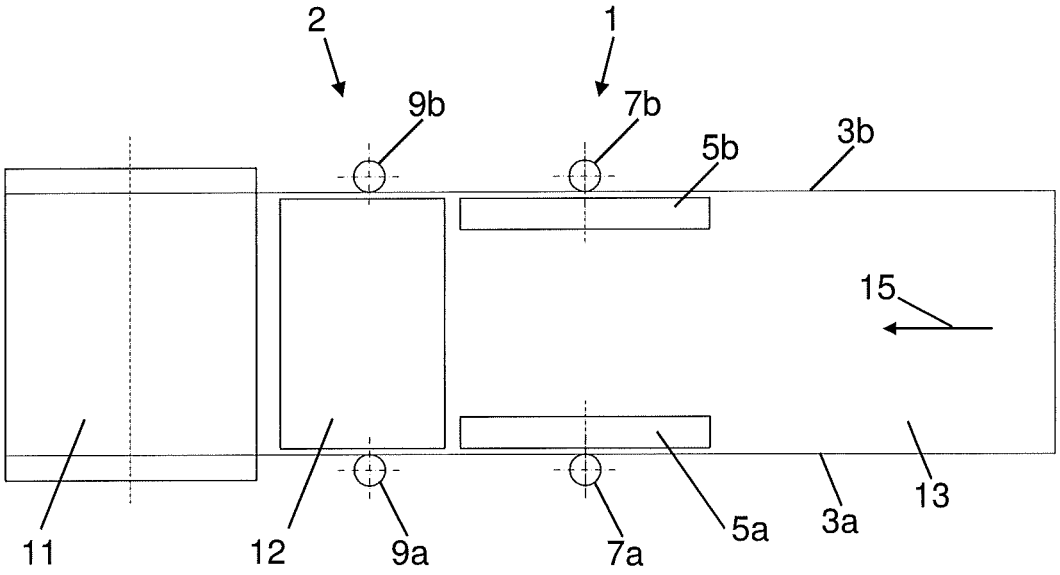
FIG. 3 is a top view schematic diagram of the embodiment of FIG. 2.

FIGS. 2-3 show an embodiment of guiding apparatus having a first ribbon-guiding assembly 1 and a second ribbon-guiding assembly 2, where each assembly includes a ribbon-curving subassembly for curving ribbon 13 along its direction of motion 15 and a pair of guide rollers (7*a*,7*b* for ribbon-guiding assembly 1 and 9*a*,9*b* for ribbon-guiding assembly 2) for engagement with the opposing edges 3*a*,3*b* of the ribbon (see FIG. 1). The apparatus of FIGS. 2-3 also includes: (a) cylindrical core 11 which rotates counterclockwise in FIG. 2 (see arrow 23) and receives ribbon 13 from the guiding apparatus and forms it into a roll; and (b) free loop 17 which provides mechanical isolation between the guiding apparatus and, for example, the apparatus (not shown) used to form the ribbon.

In the embodiment of FIGS. 2-3, different types of ribbon-curving subassemblies are used in ribbon-guiding assemblies 1 and 2, namely, a pair of cylindrical rollers 5*a*,5*b* for ribbon-guiding assembly 1 and a curved air-bar 12 for ribbon-guiding assembly 2. As illustrated in FIGS. 10-11 and 12-13, two curved air-bars 12 and 14 or two pairs of cylindrical rollers 5*a*,5*b* and 16*a*,16*b* can be used if desired. Likewise, a curved air-bar and a pair of cylindrical rollers can be used as in FIGS. 2-3 but with the air-bar upstream of the rollers. As a further variation, although generally not needed, a ribbon-curving subassembly can employ both a central curved air-bar and an outboard pair of cylindrical rollers.

Whatever ribbon-curving subassemblies are used, their purpose is to create two curved sections in the ribbon without mechanically contacting the central portion 4 of the ribbon. Thus, when a pair of cylindrical rollers is used, the rollers contact the surface of the ribbon outside of, and on opposite sides of, central portion 4. In this way, the rollers do not damage the central portion which includes the ribbon's quality portion, i.e., the portion of the ribbon which customers use in their products. The rollers also rotate with the ribbon as illustrated by arrows 21 and 25 to further minimize the chances of mechanical damage to the ribbon.

It should be noted that in FIG. 1, central portion 4 is not to scale (nor is the ribbon or the camber) in that, in practice, the central portion will typically be 90% or more of the ribbon's width, e.g., 95% or more of the width. When an air-bar is used, it can operate on the ribbon's central portion, as well as its edge portions if desired, since the physical structure of the air-bar does not make mechanical contact with the ribbon. The air (or other fluid) used with the air-bar does make physical contact with the surface of the ribbon. However, such physical contact does not constitute "mechanical contact" as that term is used herein since the ribbon is not generally susceptible to substantial mechanical damage by the fluid contact.

However formed, the two curved sections produced by the ribbon-curving subassemblies serve the role of increasing the stiffness of the ribbon so that the guide rollers can move the ribbon laterally without the ribbon buckling. The curvature, however, cannot be too sharp or the ribbon may break. In general terms, the bending stress 6 produced in a bent ribbon is given by: $\sigma \approx 0.5*E*t/R$, where E is the glass' Young's modulus, t is its thickness, and R is the radius of curvature of the bend. Thus, the curvature needs to be chosen so that the calculated bending stress does not exceed and, preferably, is substantially below the glass' flexural strength. In practice, for a representative display type glass, it has been found that a 4.5 inch (11.43 cm) radius of curvature will produce an acceptable bending stress (on the order of 50 megapascals) for a 150 micron glass thickness, while at the same time producing a level of stiffness in the ribbon sufficient to allow efficient guiding of the ribbon by the guide rollers. Larger radii of curvature have also been found to work successfully. For example, successful guiding has been achieved for the embodiment of FIGS. 2 and 3 using cylindrical rollers 5*a*,5*b* having a radius of 12 inches (30.48 cm) and a curved air-bar 12 having a radius of ~36 inches (91.44 cm). The appropriate curvatures for any particular application of the present disclosure can be readily determined by persons skilled in the art from the foregoing. It should be noted that the curvatures produced by the first and second ribbon-curving subassemblies need not be the same.

Surprisingly, it has been found that effective guiding of a thin, flexible, glass ribbon cannot be accomplished with a single curved section produced by a single ribbon-curving subassembly. With only a single curved section, the ribbon can pivot about the guiding rollers, rather than being pointed in a desired direction. With two ribbon-curving subassemblies, on the other hand, the two curved sections of the ribbon produced by the subassemblies can together define a direction for the ribbon, e.g., the direction of the centerline of a tangent plane to the two curved sections. The two pairs of guiding rollers of the two ribbon-guiding assemblies will then keep the ribbon moving in this defined direction.

To define a direction, the two ribbon-guiding assemblies need to be close enough together so that they do not become mechanically isolated from one another. Otherwise, the pivoting problem can arise again at each ribbon-guiding assembly. Similarly, the two ribbon-guiding assemblies cannot be too close together without becoming overly sensitive to small changes in the system. Generally, the onset of mechanical isolation becomes evident when the ribbon is capable of twisting between the ribbon-guiding assemblies or exhibits substantial amounts of gravitational sag between the assemblies. Supporting the ribbon between the assemblies with a flat air-bar can increase the amount of spacing between the assemblies that can be tolerated without loss of effective guiding. In general terms, for a glass ribbon composed of a display type glass, distances between the curved sections of the ribbon on the order of 0.5 to 2 meters have been found to work successfully in practice, it being expected that longer distances will also work successfully. As with the radii of curvature used for the curved sections of the ribbon, an appropriate spacing between the ribbon-guiding assemblies can be readily determined by persons skilled in the art for any particular application of the present disclosure.

Figure 4:
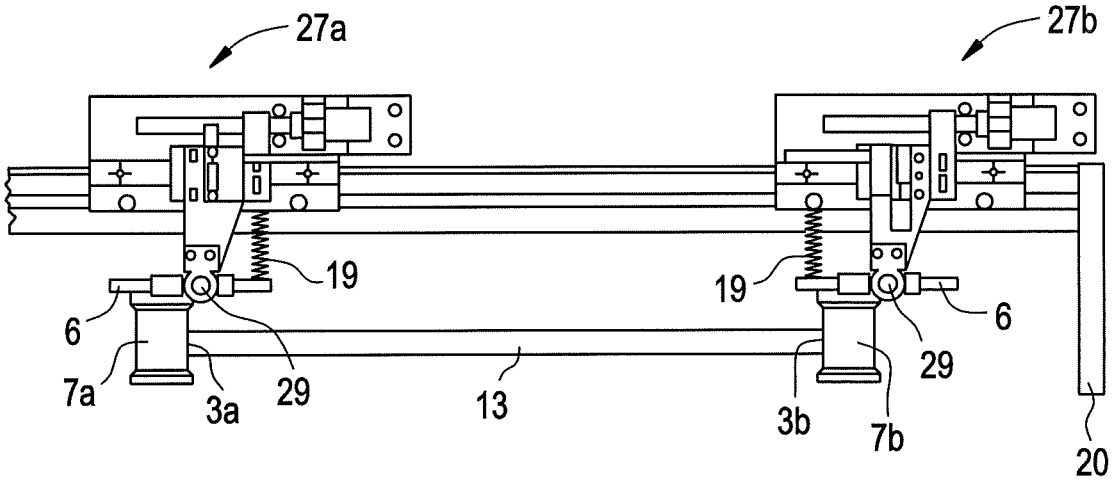
FIG. 4 is a front view of a guide roller system which uses spring-loaded pivot mechanisms for mounting cylindrical guide rollers.

FIG. 4 illustrates an embodiment of a guide roller system that can be used as part of the first and second ribbon-guiding assemblies. As shown therein, the system includes frame 20 which carries guide roller assemblies 27*a*,27*b* which are independently laterally moveable relative to the frame so as to bring guide rollers 7*a*,7*b* into contact with the opposing edges of ribbon 13. Each guide roller assembly includes a pivot 29 to which is attached a pivot arm 6. The pivot arm carries a guide roller and is biased by spring 19 to bring the surface of the roller into contact with the edge of the ribbon.

As can be seen in FIG. 4, movement of ribbon 13 to the right increases the lateral force applied to the edge of the ribbon by guide roller 7*b* and decreases the lateral force applied by guide roller 7*a*. Accordingly, the ribbon will be moved laterally back towards the centerline between the rollers, i.e., it will be moved back towards the desired direction of travel. Conversely, movement of ribbon 13 to the left will increase/decrease the force applied by guide roller 7*a*/7*b*, thus causing the ribbon to again move back towards the centerline between the rollers, in this case by moving laterally to the right. In this way, the guide roller system will cause the ribbon to automatically experience a lateral restoring force appropriate to its deviation from the desired direction of motion for the ribbon.

Because the guide rollers are mounted on spring loaded pivots, the amount of force that is exerted on the edges of the glass ribbon can be easily controlled through the selection of springs 19. In practice, a lateral force of approximately 0.4-0.5 pounds (0.181 kg to 0.227 kg) has been found to work successfully with a glass ribbons having thicknesses in the range of 0.075 to 0.22 mm and a width of 40 centimeters. Suitable lateral forces for other ribbon dimensions can be readily determined by persons skilled in the art for any particular application of the present disclosure.

Figure 5:
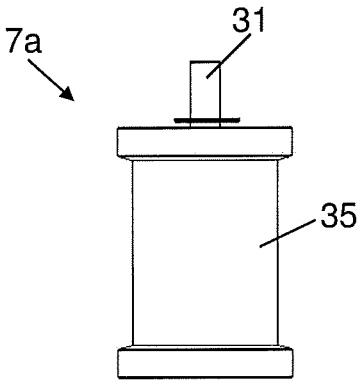
FIG. 5 is a side view of a cylindrical guide roller.
Figure 6:
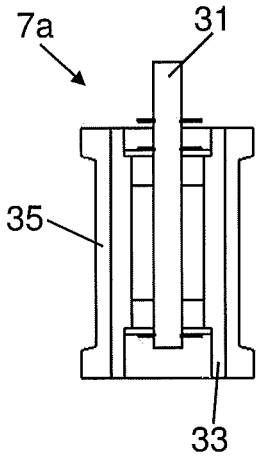
FIG. 6 is a cross section of the cylindrical guide roller of FIG. 5.

As shown in FIGS. 5 and 6, the guide roller can include a shaft 31 to which is rotatably mounted a frame 33 which is covered with a resilient coating or sleeve 35. The coating or sleeve can, for example, be composed of a silicone rubber or a similar low-friction complaint material capable of minimizing damage to the edge of the ribbon, e.g., besides silicone rubber, the sleeve can be composed natural rubber, neoprene, or generally any complaint material coated with TEFLON.

Although illustrated for first and second guide rollers 7*a*,7*b*, the guide roller system and guide roller construction of FIGS. 4, 5, and 6 can also be used for third and fourth guide rollers 9*a*,9*b*. Guide roller systems and guide roller constructions other than those illustrated in these figures can, of course, be used in the practice of the ribbon guiding technology disclosed herein.

Figure 7:
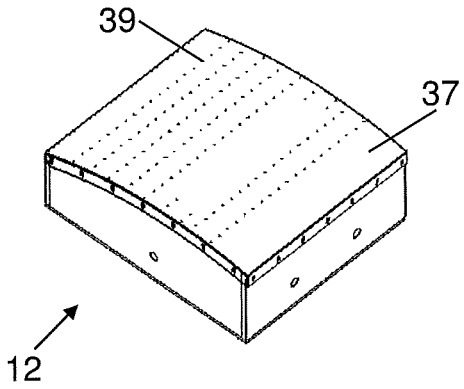
FIG. 7 is a perspective view of a curved air-bar for non-contact support of glass between guide roller pairs.
Figure 8:
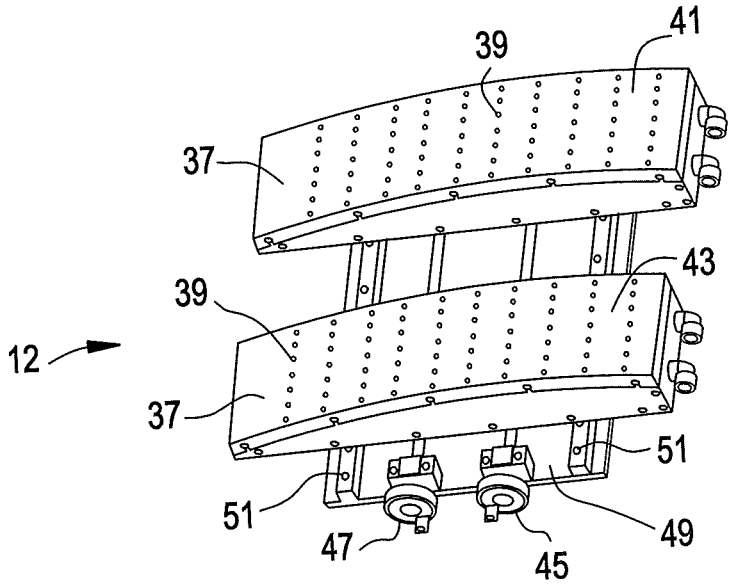
FIG. 8 is a perspective view of a curved air-bar assembly having two air-bar subsections which are independently laterally moveable with respect to one another.
Figure 9:
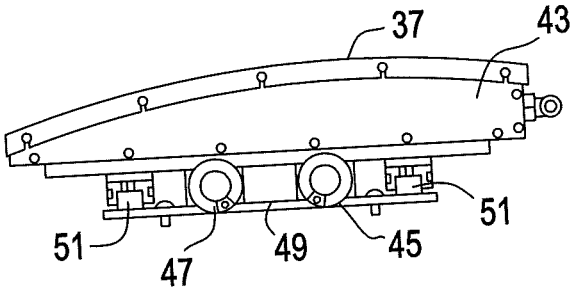
FIG. 9 is a side view of the curved air-bar assembly of FIG. 8.
Figure 10:
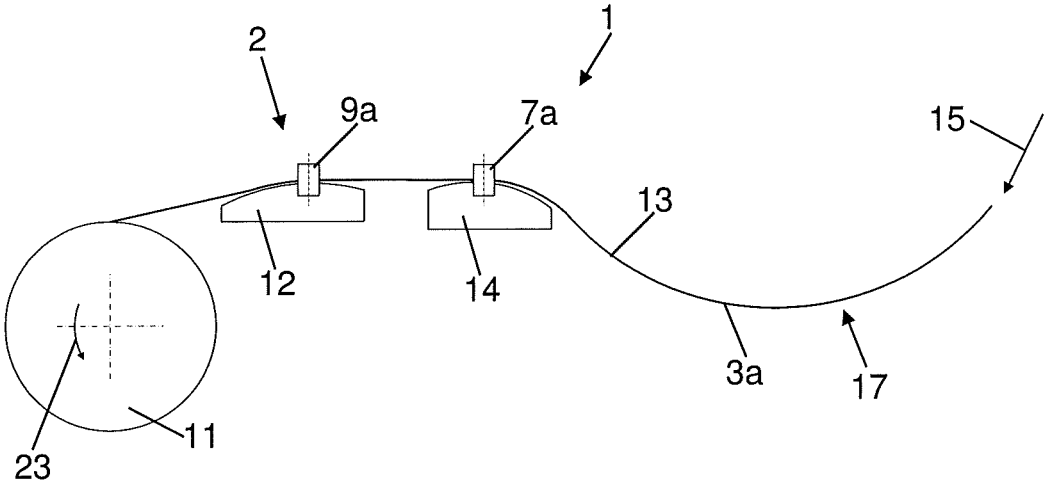
FIG. 10 is a side view schematic diagram of an embodiment of the present disclosure.
Figure 11:
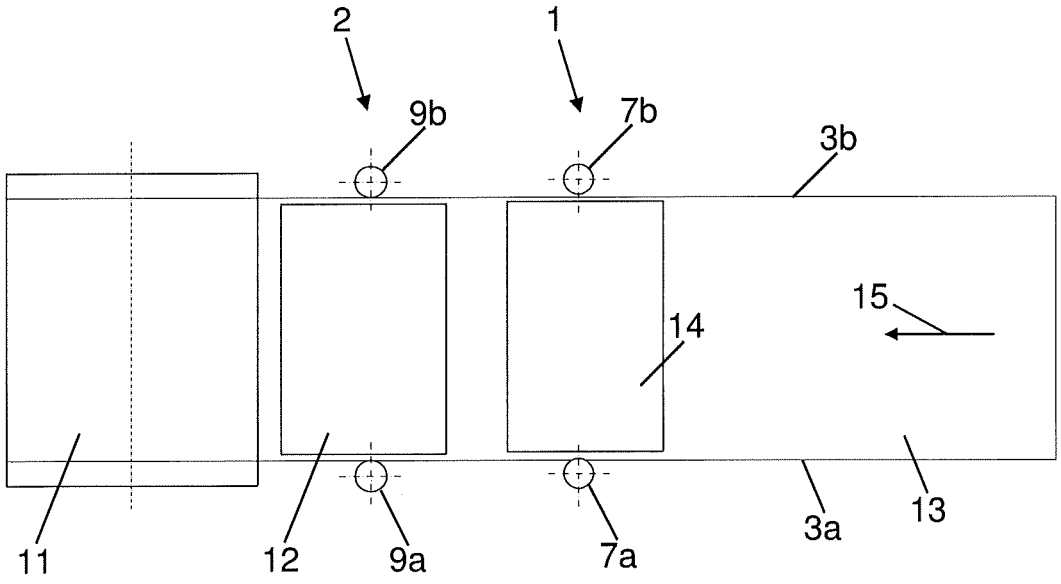
FIG. 11 is a top view schematic diagram of the embodiment of FIG. 10.
Figure 12:
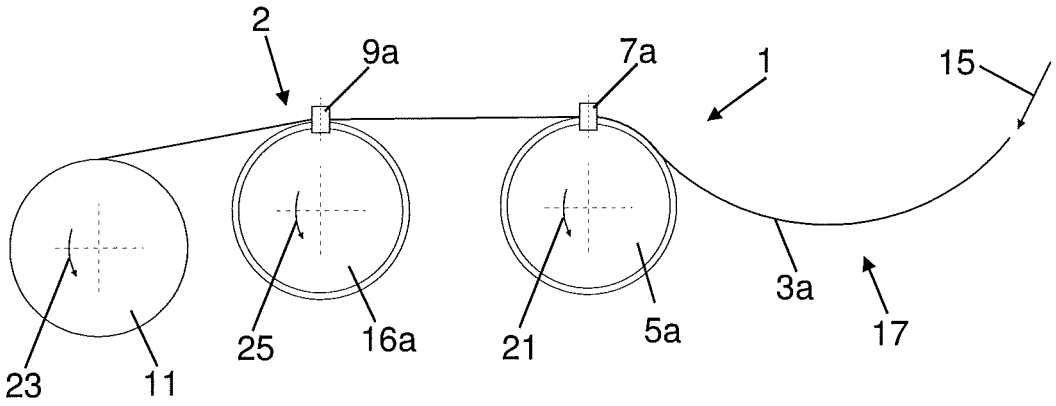
FIG. 12 is a side view schematic diagram of an embodiment of the present disclosure.
Figure 13:
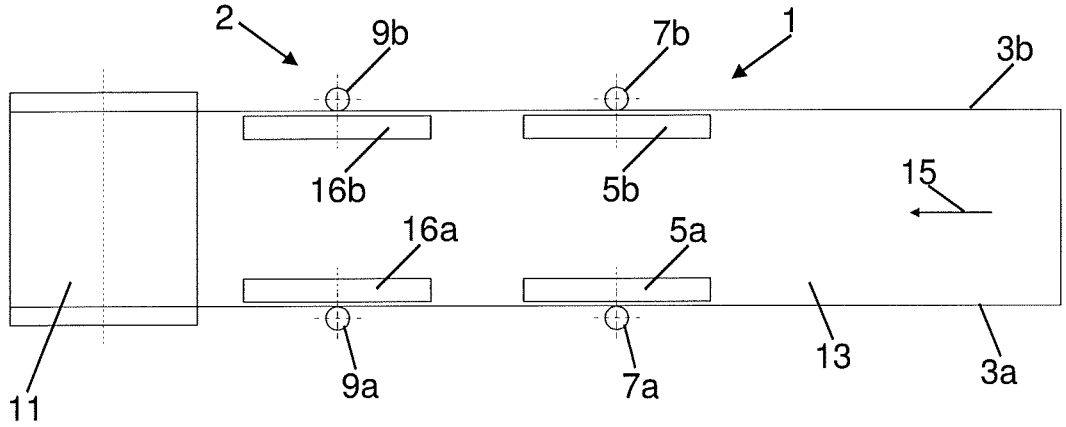
FIG. 13 is a top view schematic diagram of the embodiment of FIG. 12.

FIGS. 7-9 show air-bar assemblies that can be used as part of the first and second ribbon-curving subassemblies. In particular, FIG. 7 shows an air-bar assembly having a one piece curved face 37 penetrated by apertures 39, while FIGS. 8-9 show an air-bar having first and second air-bar subsections 41 and 43. In the embodiment of FIGS. 8-9, the subsections are mounted on rails 51 carried by frame 49 and are independently moveable along the rails through the rotation of first and second gear assemblies 45 and 47. In this way, the lateral positions of the subsections relative to the surface of the ribbon can be independently adjusted. For example, both subsections can be laterally located so that the air or other fluid exiting apertures 39 strikes the central portion 4 of the ribbon. Alternatively, the subsections can be mounted so that they operate on the outer portions of the ribbon in a manner similar to that of cylindrical rollers 5*a*,5*b* and 16*a*,16*b* in the embodiments of FIGS. 2-3 and 12-13. The arrangement and size of apertures 39 and the shape of face 37 follow conventional air-bar technology, with the proviso that the force applied to the ribbon needs to spread across a sufficiently large area so as to avoid localized bulging of the ribbon. Air-bar constructions other than those illustrated can, of course, be used in the practice of the ribbon guiding technology disclosed herein.

Figure 14:
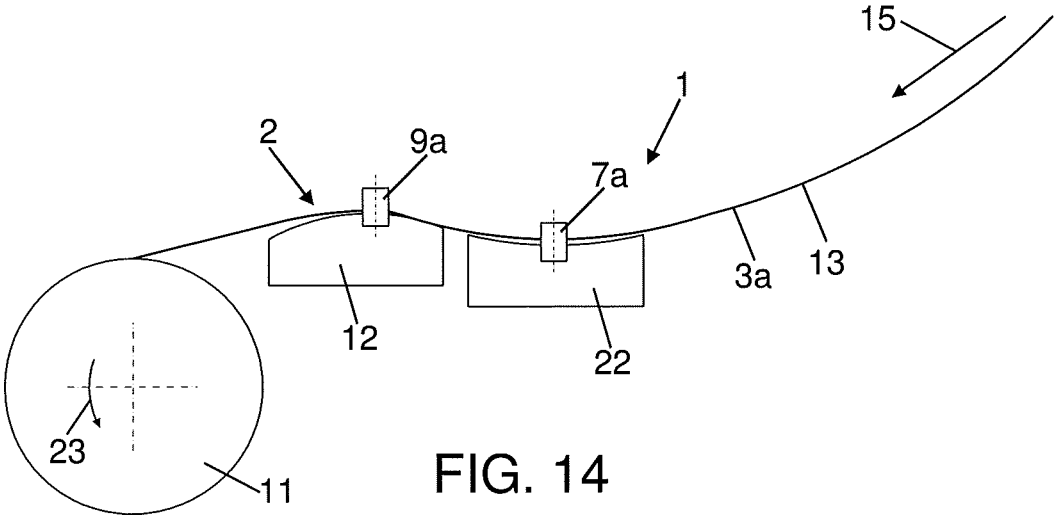
FIG. 14 is a side view schematic diagram of an embodiment of the present disclosure.
Figure 15:
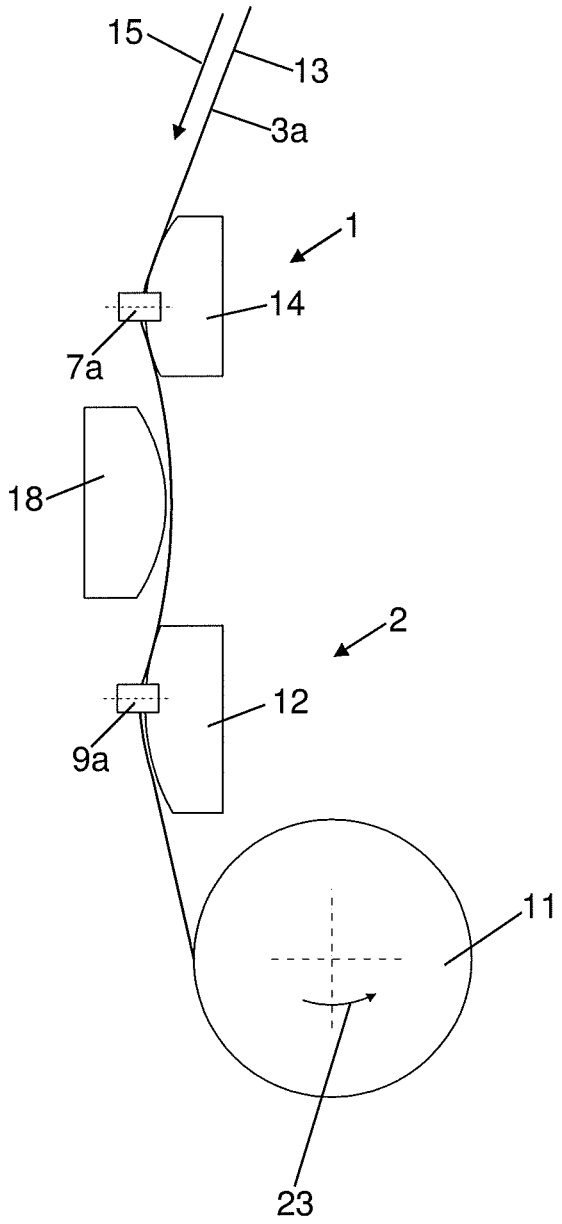
FIG. 15 is a side view schematic diagram of an embodiment of the present disclosure.

FIGS. 14 and 15 show further embodiments for the ribbon guiding system. In the FIG. 14 embodiment, the first ribbon guiding assembly 1 employs a concave air-bar 22 in place of the convex air-bar 14 of the embodiment of FIGS. 10-11, and in the embodiment of FIG. 15, the ribbon's overall motion includes primarily a vertical component, rather than primarily a horizontal component as in the embodiments of FIGS. 2-3, 10-11, 12-13, and 14. To bias ribbon 13 against the first and second ribbon-curving subassemblies 14 and 12 of FIG. 15, the FIG. 15 embodiment includes ribbon-biasing assembly 18 which can, for example, be a curved air-bar or a pair of cylindrical rollers. As can be seen in FIG. 15, the ribbon-biasing assembly 18 produces a further curved section in the ribbon between the curved sections produced by ribbon-curving subassemblies 12 and 14.

As discussed above, one application for the ribbon guiding systems disclosed herein is in connection with the winding of a glass ribbon. In accordance with an embodiment of such winding, ribbon 13 is manufactured continuously and once the manufacturing process is stable, the ribbon is formed into a free loop 17 and then for the embodiment of FIGS. 2-3, threaded over the top of a set of narrow cylindrical rollers 5*a*, 5*b* (which can be configured like "wagon wheels" for example), which support the glass toward its edges, and between the first set of guide rollers 7*a*,7*b*. The ribbon is then supported by a cushion of air supplied by curved air-bar 12. A second set of guide rollers 9*a*,9*b* located just outside the air-bar further define the lateral position of the glass ribbon. With the lateral position of the glass ribbon now established, it is wound onto a cylindrical core 11. The process continues until the cylindrical core is full. A cross cut device (not shown) then creates a trailing edge. The operator wraps and tapes this trailing edge to the newly-formed glass roll and removes the finished roll. The operator then loads a new core and the process is repeated. Similar steps can be used with the equipment of the embodiments of FIGS. 10-11, 12-13, 14, and 15.

In practice, the foregoing winding procedure has been successfully used to wind glass lengths of greater than 200 m on a cylindrical core. The camber of the glass ribbon being wound was measured to be approximately 3 mm over a 5.5 m length and the cross-web thickness variation was measured to be 0.013 mm for 0.15 mm thick material.

From the foregoing, it can be seen that apparatus and methods for guiding a thin, flexible, glass ribbon have been provided which create sufficient forces to effectively guide the glass web laterally, despite the potential existence of camber or thickness variation in the glass. In some embodiments (see, for example, FIGS. 10-11, 14, and 15), these forces can be produced without any mechanical contact with the major surfaces of the glass ribbon. Moreover, the total force applied to the edge of the glass can be limited (e.g., through the pivot system of FIG. 4) so as to minimize the creation of defects that could lead to breakage. Similarly, by coating the guide rollers with a complaint, low friction material, the edges of the glass can be further protected from the generation of defects that could result in breakage.

A variety of modifications that do not depart from the scope and spirit of the invention will be evident to persons of ordinary skill in the art from the foregoing disclosure. The following claims are intended to cover the specific embodiments set forth herein as well as modifications, variations, and equivalents of those embodiments.

What is claimed is:

1. Apparatus for guiding a moving glass ribbon having a central portion and extending along a plane encompassing first and second edges of the glass ribbon, comprising:

(a) a first ribbon-guiding assembly comprising:

(i) a first ribbon-curving subassembly for producing a first curved section of the ribbon that extends along a curved portion of the plane without mechanically contacting the central portion of the ribbon, the curvature of the section being along the direction of motion of the ribbon; and (ii) first and second guide rollers each including a respective rotational axis intersecting the plane, wherein the first and second guide rollers are configured to engage and apply a lateral force to, respectively, the first and second edges of the ribbon, the engagement being in or mechanically adjacent the first curved section of the ribbon; and (b) a second ribbon-guiding assembly comprising:

(i) a second ribbon-curving subassembly for producing a second curved section of the ribbon that extends along a curved portion of the plane without mechanically contacting the central portion of the ribbon, the curvature of the section being along the direction of motion of the ribbon; and (ii) third and fourth guide rollers each including a respective rotational axis intersecting the plane, wherein the first and second guide rollers are configured to engage and apply a lateral force to, respectively, the first and second edges of the ribbon, the engagement being in or mechanically adjacent the second curved section of the ribbon; wherein the curvatures of each of the first and second sections stiffens the ribbon to an extent sufficient to permit the guide rollers to laterally move the ribbon without causing it to buckle.

2. The apparatus of claim 1 wherein:

(a) the first ribbon-curving subassembly comprises at least one of:

(i) a curved air-bar, and (ii) a pair of cylindrical rollers which contact the surface of the ribbon outside of, and on opposite sides of, the ribbon's central portion; and (b) the second ribbon-curving subassembly comprises at least one of:

(i) a curved air-bar, and (ii) a pair of cylindrical rollers which contact the surface of the ribbon outside of, and on opposite sides of, the ribbon's central portion.

3. The apparatus of claim 1 wherein each of the guide rollers is carried by a pivot arm and each of the pivot arms is spring-loaded to bias its guide roller against the edge of the ribbon.

4. The apparatus of claim 1 wherein each of the guide rollers has a glass-engaging surface which comprises silicone rubber.

5. The apparatus of claim 1 wherein the apparatus comprises a ribbon-biasing assembly between the first and second ribbon-guiding assemblies for biasing the ribbon towards the first and second ribbon-curving subassemblies without mechanically contacting the central portion of the ribbon.

6. The apparatus of claim 5 wherein the ribbon-biasing assembly comprises at least one of:

(a) a curved air-bar, and (b) a pair of cylindrical rollers which contact the surface of the ribbon outside of, and on opposite sides of, the ribbon's central portion.

7. The apparatus of claim 1 wherein at least one of the first and second ribbon-curving subassemblies comprises a curved air-bar having first and second curved air-bar subsections whose across-the-ribbon positions are independently adjustable.

8. The apparatus of claim 1 wherein the ribbon's central portion is at least 90% of the ribbon's width.

9. Apparatus for winding a moving glass ribbon onto a cylindrical core comprising the apparatus of claim 1.

* * * * *